US010730025B2

(12) United States Patent
Tang

(10) Patent No.: US 10,730,025 B2
(45) Date of Patent: Aug. 4, 2020

(54) STIRRING DEVICE FOR TREATMENT OF PHOTORESIST SETTLEMENT AND PHOTORESIST TANK

(71) Applicant: WUHAN CHINA STAR OPTOELECTRONICS TECHNOLOGY CO., LTD., Wuhan, Hubei (CN)

(72) Inventor: Ninglin Tang, Hubei (CN)

(73) Assignee: WUHAN CHINA STAR OPTOELECTRONICS TECHNOLOGY CO., LTD, Wuhan (CN)

( * ) Notice: Subject to any disclaimer, the term of this patent is extended or adjusted under 35 U.S.C. 154(b) by 527 days.

(21) Appl. No.: 15/539,732

(22) PCT Filed: Apr. 12, 2017

(86) PCT No.: PCT/CN2017/080236
§ 371 (c)(1),
(2) Date: Jun. 26, 2017

(87) PCT Pub. No.: WO2018/170964
PCT Pub. Date: Sep. 27, 2018

(65) Prior Publication Data

US 2019/0388853 A1 Dec. 26, 2019

(30) Foreign Application Priority Data

Mar. 24, 2017 (CN) ..... 2017 1 0181986

(51) Int. Cl.
*B01F 7/00* (2006.01)
*B01F 7/18* (2006.01)
*B01F 15/00* (2006.01)

(52) U.S. Cl.
CPC ..... *B01F 7/00716* (2013.01); *B01F 7/00058* (2013.01); *B01F 7/0095* (2013.01); *B01F 7/18* (2013.01); *B01F 15/00506* (2013.01)

(58) Field of Classification Search
CPC ..... B01F 7/00716; B01F 7/00058; B01F 15/00506; B01F 7/0095
See application file for complete search history.

(56) References Cited

U.S. PATENT DOCUMENTS 364,059 A * 5/1887 Stauffert ..... B01F 13/002 366/285
955,978 A * 4/1910 Mitchell ..... A01J 15/24 366/254

(Continued)

FOREIGN PATENT DOCUMENTS

CN 201997280 U 10/2011
CN 103176308 A 6/2013

(Continued)

OTHER PUBLICATIONS

International Search Report dated Dec. 27, 2017 for International Patent Application No. PCT/CN2017/080236.

(Continued)

*Primary Examiner* — Tony G Soohoo

(57) ABSTRACT

Involved is the technical field of a stirring device, specifically a stirring device for treatment of photoresist settlement and a photoresist tank. The stirring device includes a sleeve shaft, an inner telescopic shaft, a stirring component, and a rotary rod, wherein, the rotary rod is mounted on an upper end of the sleeve shaft for driving the sleeve shaft to rotate; the stirring component is arranged on a lower end of the sleeve shaft and rotates with the sleeve shaft; and the inner telescopic shaft is arranged inside of the sleeve shaft and connected to the stirring component for controlling opening and closing of the stirring component. Stirring plates (Continued)

approach a bottom portion of the photoresist tank, at which moment manual control is adopted to control stirring of the stirring device upward from the bottom gradually, so as to achieve the objective of homogeneous component of the photoresist. The photoresist is stirred to be more homogeneous. A lot of manpower and material resources are saved. The stirring device enables high stirring speed and high safeness.

20 Claims, 3 Drawing Sheets

(56) References Cited

U.S. PATENT DOCUMENTS 1,711,114 A * 4/1929 Hunt ..... B01F 7/0005 416/142
1,734,120 A * 11/1929 Farrington ..... B01F 7/1695 366/308
1,827,004 A * 10/1931 Gibson ..... B01F 7/1695 366/308
2,896,926 A * 7/1959 Chapman ..... B01F 7/00058 416/66
3,132,850 A * 5/1964 Puchalski ..... B01F 7/1695 366/308
3,455,540 A * 7/1969 Marcmann ..... B01F 7/00066 416/142
3,559,962 A * 2/1971 Enssle ..... B01F 7/00066 366/308
4,264,215 A * 4/1981 Nunlist ..... B01F 7/00275 366/279
4,519,714 A * 5/1985 Johnson ..... B01F 7/00733 366/279
5,192,131 A * 3/1993 Hatfield ..... B01F 7/00058 366/308
5,282,681 A * 2/1994 Supelak ..... B01F 7/00733 366/244
5,351,850 A * 10/1994 Brieskorn ..... B21D 51/20 220/601
5,366,289 A * 11/1994 Supelak ..... B01F 7/00733 366/244
5,402,909 A * 4/1995 Cramer ..... B65D 1/20 220/601
5,411,331 A * 5/1995 Griffin ..... B01F 7/00066 222/228
5,489,151 A * 2/1996 Weber ..... B01F 7/0005 366/247
5,885,001 A * 3/1999 Thomas ..... B01F 7/00066 366/308
5,941,636 A * 8/1999 Lu ..... B01F 7/00066 366/249
6,223,930 B1 * 5/2001 Watson ..... B65D 1/16 220/4.04
6,749,331 B1 * 6/2004 Hughes ..... B01F 7/161 366/191
8,408,418 B2 * 4/2013 Kuzelka ..... B01F 15/00006 220/600
9,074,171 B2 * 7/2015 Gueneron ..... C12M 23/26
9,604,183 B2 * 3/2017 Dinnison ..... B01F 7/00341
9,713,799 B2 * 7/2017 Mattson ..... B01F 7/00058
10,105,662 B1 * 10/2018 Mattson ..... B01F 7/00066
2004/0208081 A1 * 10/2004 Hughes ..... B01F 7/161 366/191
2010/0195432 A1 * 8/2010 Laurence ..... B44D 3/08 366/139
2015/0259501 A1 * 9/2015 Nakahara ..... B01D 1/225 521/45
2016/0259172 A1 9/2016 Wu
2017/0084572 A1 3/2017 Liu et al.

FOREIGN PATENT DOCUMENTS

CN 103831042 A 6/2014
CN 204352825 U 5/2015
CN 204406030 U 6/2015
CN 205386421 U 7/2016
CN 205538860 U 8/2016
WO 2017021653 A1 2/2017

OTHER PUBLICATIONS

Chinese Office Action dated Feb. 5, 2018 for Chinese Patent Application No. 201710181986.0.

* cited by examiner

STIRRING DEVICE FOR TREATMENT OF PHOTORESIST SETTLEMENT AND PHOTORESIST TANK

CROSS-REFERENCE TO RELATED APPLICATIONS

This application claims the priority of Chinese patent application CN 201710181986.0, entitled "Stirring device for treatment of photoresist settlement and photoresist tank" and filed on Mar. 24, 2017, the entirety of which is incorporated herein by reference.

FIELD OF THE INVENTION

The present disclosure relates to the technical field of a stirring device, and in particular, to a stirring device for treatment of photoresist settlement and a photoresist tank.

BACKGROUND OF THE INVENTION

In the manufacture of TFT-LCDs (liquid crystal display devices), a photoresist is required, wherein in the manufacture of a CF (color filter) substrate, necessary RGB photoresist has a strict requirement for the homogeneity of a photoresist amount. The long-distance transportation and the long-period storage of the photoresist may result in the settlement thereof. In a photoresist tank, the amount of photoresist in an upper part is smaller than that in a lower part. Since the CF adopts the negative photoresist (i.e., a part of exposed photoresist will be retained), if the homogeneity of the photoresist is not good, after the procedures of vacuum pumping and preheating, the amounts of retained photoresist may be different due to the volatilization of a solvent in the photoresist, which results in a difference in characteristic values, thereby influencing the quality of the products.

An existing photoresist tank has no design for preventing or treating the photoresist settlement. A commonly adopted treating procedure is to roll or sway the photoresist tank. Since the photoresist tank is heavy, the operation is inconvenient. Moreover, since the photoresist is inflammable and possesses some toxicity, there also exists a safety problem in the operation.

SUMMARY OF THE INVENTION

Based on the above defects and problems, the present disclosure provides a stirring device for treatment of photoresist settlement and a photoresist tank.

In order to achieve the above objective, the present disclosure provides a stirring device for treatment of photoresist settlement, comprising:

a sleeve shaft, an inner telescopic shaft, a stirring component, and a rotary rod; wherein, wherein the rotary rod is mounted on an upper end of the sleeve shaft for driving the sleeve shaft to rotate; the stirring component is mounted on a lower end of the sleeve shaft and rotates with the sleeve shaft; and the inner telescopic shaft is mounted inside of the sleeve shaft and connected to the stirring component for controlling opening and closing of the stirring component.

In the above stirring device for treatment of photoresist settlement, the stirring component comprises two stirring plates having a same structure and being symmetrically arranged, wherein one end of the stirring plate is in a semicircle shape and another end thereof is in a vertical shape; and a groove is provided on a side of an upper portion of the stirring plate, and is connected to the semicircle shape.

In the above stirring device for treatment of photoresist settlement, the two stirring plates show a horizontal straight line when they are pushed open.

In the above stirring device for treatment of photoresist settlement, the sleeve shaft is in a cask shape.

In the above stirring device for treatment of photoresist settlement, openings are provided on two sides of a lower portion of the sleeve shaft.

In the above stirring device for treatment of photoresist settlement, a movable coupling is mounted on a lower end of the inner telescopic shaft; two connecting plates are arranged in the openings, upper ends of the two connecting plates being connected to the movable coupling respectively, and lower ends of the two connecting plates being connected to the stirring component respectively.

In the above stirring device for treatment of photoresist settlement, the two connecting plates are arranged in an inclined way.

In the above stirring device for treatment of photoresist settlement, height of the sleeve shaft is smaller than that of the inner telescopic shaft.

In the above stirring device for treatment of photoresist settlement, the rotary rod is in a shape of transverse "L."

A photoresist tank comprises a photoresist exit constructed on a tank body, on which a round mouth for going in and out by the stirring device for treatment of photoresist settlement is also constructed.

In the above technical solutions, the stirring device for treatment of photoresist settlement provided in the present disclosure unfolds the stirring component with the inner telescopic shaft. The rotary rod drives the sleeve shaft to rotate, and the stirring component rotates with the sleeve shaft. Stirring is carried out from a bottom portion of the stirring device upward gradually so that the photoresist is stirred more homogeneous. The stirring device is convenient and efficient for use. A lot of manpower and material resources are saved. The stirring device enables rapid stirring speed and high safeness.

Since the stirring device for treatment of photoresist settlement possesses the above technical effects, the photoresist tank comprising the device should also possess the corresponding technical effects.

As long as the objective of the present disclosure can be achieved, the above technical features can be combined in various suitable manners or substituted by equivalent technical features.

BRIEF DESCRIPTION OF THE DRAWINGS

The present disclosure will be described in a more detailed way below based on embodiments and with reference to the accompanying drawings, in which.

DETAILED DESCRIPTION OF THE EMBODIMENTS

In the following, the present disclosure will be further illustrated in combination with the drawings.

Figure 1:
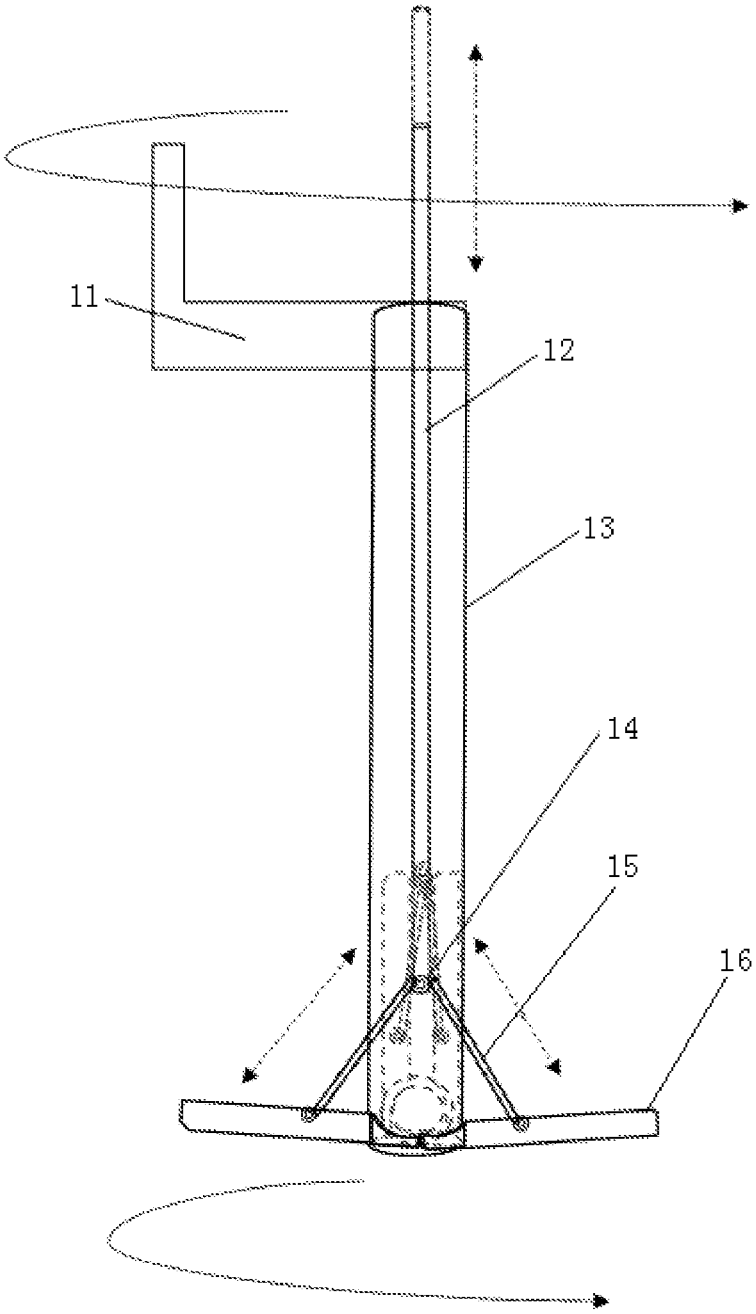
FIG. 1 is a structural diagram of a stirring device for treatment of photoresist settlement in one embodiment of the present disclosure.

FIG. 1 schematically shows a stirring device for treatment of photoresist settlement, comprising:

a sleeve shaft 13, an inner telescopic shaft 12, a stirring component, and a rotary rod 11, wherein the rotary rod 11 is mounted on an upper end of the sleeve shaft 13 for driving the sleeve shaft 13 to rotate; the stirring component is mounted on a lower end of the sleeve shaft 13 and rotates with the sleeve shaft 13; and the inner telescopic shaft 12 is arranged inside of the sleeve shaft 13 and connected to the stirring component for controlling opening and closing of the stirring component. The stirring device brings about excellent stirring effects, has a simple structure, enables convenient and efficient operations, and improves the safety performance.

As shown in FIG. 1, in one preferred embodiment, the sleeve shaft 13 is in a cask shape, which is convenient for mounting and operations. The sleeve shaft 13 is made of a metal or hard plastic material, which is for the convenience of mounting and operations.

As shown in FIG. 1, in one preferred embodiment, height of the sleeve shaft 13 is smaller than that of the inner telescopic shaft 12, which is convenient for taking out the inner telescopic shaft 12 and the stirring component. Thus the maintenance and the package thereof are convenient and efficient.

As shown in FIG. 1, in one preferred embodiment, the rotary rod 11 is in a shape of transverse "L." Such a rotary rod is convenient to hold in hand and its join force is good and thus can provide a driving force for the sleeve shaft 13 in a better way. The rotary rod 11 is welded on one side of the upper end of the sleeve shaft 13 with fastness and thus is difficult to destroy.

Furthermore, the rotary rod 11 can be further connected to a mechanical arm. Labor force can be saved with the rotation of the rotary rod 11 driven by the mechanical arm.

As shown in FIG. 1, in one embodiment, furthermore, openings (not shown in the figure) are provided on two sides of the lower end of the sleeve shaft 13. This enables the stirring component to be opened and closed, and thus forms torque transmission during rotation thereof, so as to achieve better stirring effects.

Figure 2:
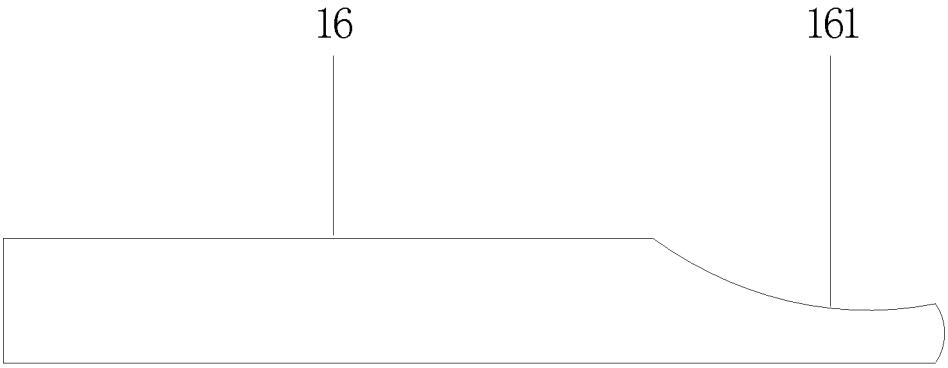
FIG. 2 is a structural diagram of a stirring plate of a stirring device for treatment of photoresist settlement in one embodiment of the present disclosure.

As shown in FIG. 1 and FIG. 2, in one embodiment, the stirring component comprises two stirring plates 16 having a same structure and being symmetrically mounted. One end of the stirring plate 16 is in a semicircle shape and another end thereof is in a vertical shape. A groove 161 is provided on a side of an upper portion of the stirring plate 16, and is connected to the semicircle shape. This facilitates flexible folding and unfolding of the two stirring plates 16, and will not cause a jam phenomenon.

Furthermore, a sum of width of the two stirring plates 16 and a diameter of the inner telescopic shaft 12 is smaller than a diameter of the sleeve shaft 13. The two stirring plates 16 and the inner telescopic shaft 12 can be received in the sleeve shaft 13. This is convenient for disassembly and maintenance. For example, the stirring plates 16 can be folded to fit to the inner telescopic shaft 12, such that the inner telescopic shaft 12 can be pulled out directly together with the stirring plates 16 under the circumstance of not pulling out the sleeve shaft 13. This is convenient for use, maintenance, and storage.

Furthermore, two connecting plates 15 are arranged in an inclined way. The two stirring plates 16 are unfolded by the two connecting plates 15. The two stirring plates 16 show a horizontal straight line when being unfolded. The two connecting plates 15 and the two stirring plates 16 show a triangle shape. A support force is more concentrated and the stability is better. The stirring plates 16 of different sizes can be selected based on actual requirements.

As shown in FIG. 1, in one preferred embodiment, a movable coupling 14 is arranged on a lower end of the inner telescopic shaft 12. The two connecting plates 15 are arranged in the openings. Upper ends of the two connecting plates 15 are connected to the movable coupling 14, respectively, and lower ends of the two connecting plates 15 are connected to the stirring component, respectively. This facilitates folding and will not cause a jam phenomenon. An axle ring design is adopted between the stirring plates 16 and the inner telescopic shaft 12. This design facilitates the folding and unfolding of the stirring plates 16.

In one preferred embodiment, an electronic timer can be also mounted on the rotary rod 11, to facilitate checking of the stirring time, and a preferred stirring duration lasts for 3-5 minutes. This can improve the work efficiency.

Figure 3:
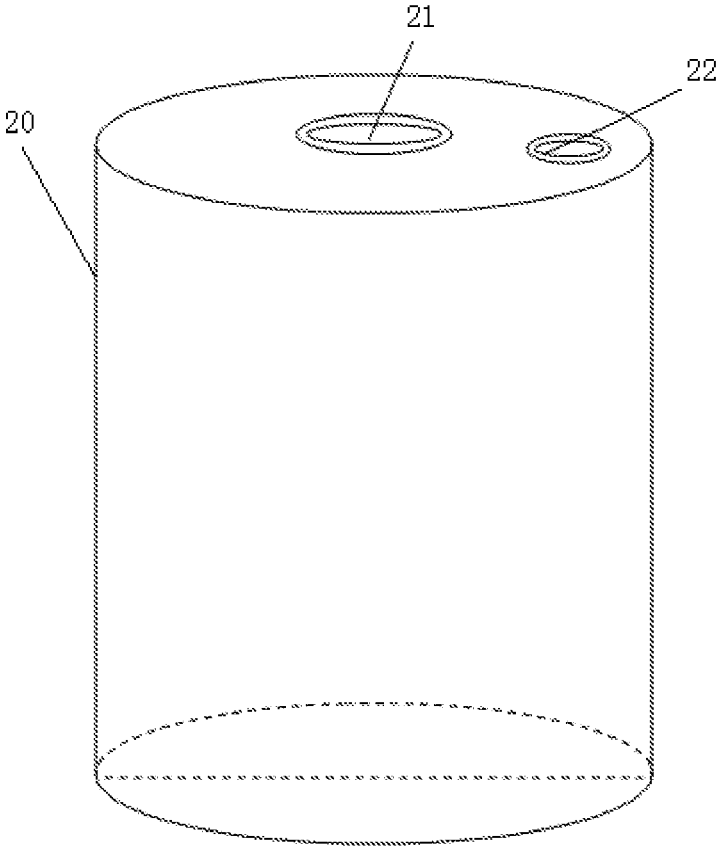
FIG. 3 is a structural diagram of a tank body of a photoresist tank in one embodiment of the present disclosure.
Figure 4:
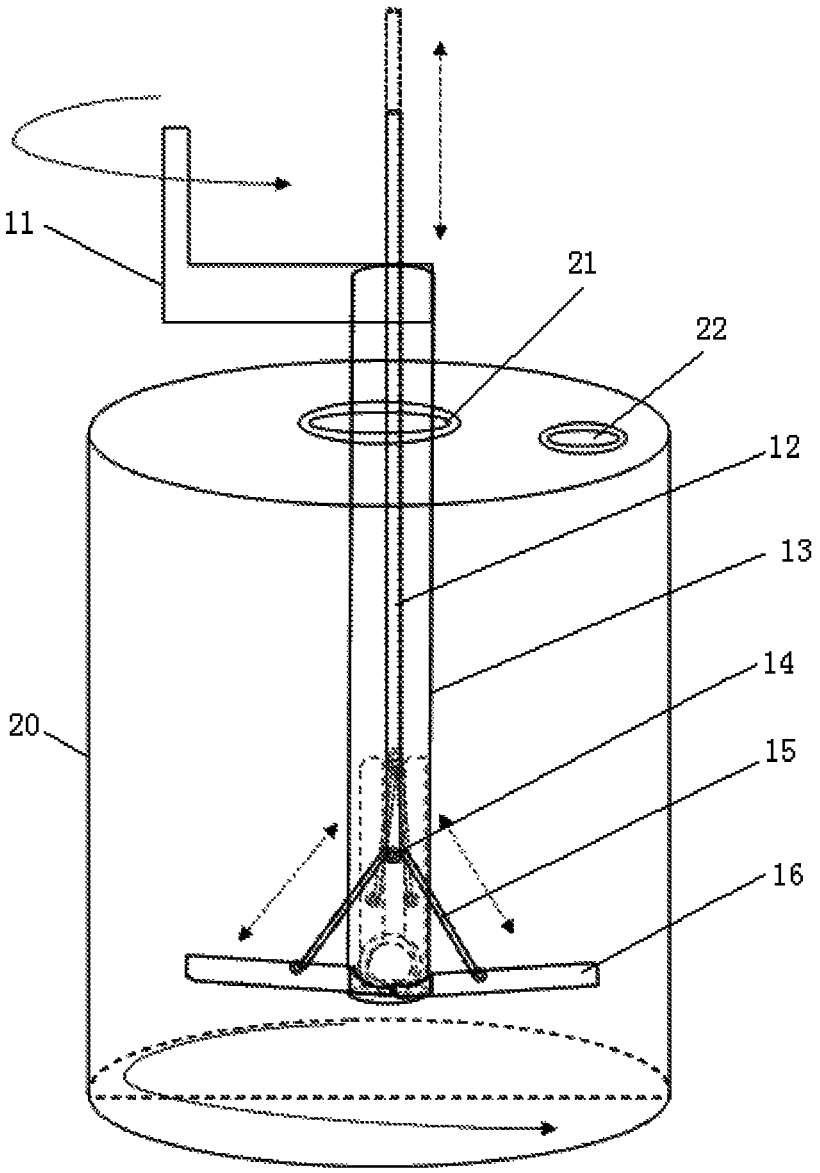
FIG. 4 is a structural diagram of a photoresist tank in one embodiment of the present disclosure.

FIG. 3 and FIG. 4 schematically show the photoresist tank, comprising a photoresist outlet 22 constructed on a tank body 20, on which a round opening 21 is further constructed for entry and exit of the stirring device for the treatment of photoresist settlement. A total length of the two stirring plates 16 in the stirring device is smaller than a diameter of the tank body 20.

In specific use, the round opening 21 of the photoresist tank is opened; the stirring device is arranged in the photoresist tank; the inner telescopic shaft 12 is pressed downward to open the two stirring plates 16; the rotary rod 11 drives the sleeve shaft 13 and the stirring plates 16 to rotate; and the stirring plates 16 approach a bottom portion of the photoresist tank. At this moment, manual control is adopted to control stirring of the stirring device upward from the bottom gradually, so as to achieve the objective of homogeneous component of the photoresist. The stirring of the photoresist is thus more homogeneous. The stirring device is convenient and efficient for use, saves a lot of manpower and material resources, and is of rapid stirring speed and high safeness.

The present disclosure is described by referring to the preferred embodiments. Under the condition of not departing from the scope of the present disclosure, any skilled person can make any improvements and replace its components with equivalents. Particularly, as long as there is no structural conflict, all technical features mentioned in all the embodiments can be combined in any manners. The present disclosure is not limited to the specific embodiments disclosed herein but includes all the technical solutions falling within the scope of the claims.

The invention claimed is:

1. A stirring device, comprising:

a sleeve shaft (13), an inner telescopic shaft (12), a stirring component, and a rotary rod (11), wherein the rotary rod (11) is mounted on an upper end of the sleeve shaft (13) for driving the sleeve shaft (13) to rotate;

wherein the stirring component is mounted on a lower end of the sleeve shaft (13) and rotates with the sleeve shaft (13); and wherein the inner telescopic shaft (12) is mounted inside of the sleeve shaft (13) and connected to the stirring component for controlling opening and closing of the stirring component;

wherein the stirring component comprises two stirring plates, a sum of width of the two stirring plates (16) and a diameter of the inner telescopic shaft (12) is smaller than a diameter of the sleeve shaft (13), the two stirring plates (16) and the inner telescopic shaft (12) are received in the sleeve shaft (13) when folded to fit to the inner telescopic shaft (12) such that the inner telescopic shaft (12) has a capability to be pulled out directly together with the stirring plates (16) from the sleeve shaft (13).

2. The stirring device according to claim 1, wherein the two stirring plates (16) which have a same structure and are symmetrically arranged, wherein the stirring plate (16) has one end in a semicircle shape and another end in a vertical shape; and wherein a groove (161) is provided on a side of an upper portion of the stirring plate (16), and is connected to the semicircle shape.

3. The stirring device according to claim 2, wherein the two stirring plates (16) show a horizontal straight line when they are pushed open.

4. The stirring device according to claim 1, wherein the sleeve shaft (13) is hollow cylindrical.

5. The stirring device according to claim 1, wherein openings are provided on two sides of a lower portion of the sleeve shaft (13) for the stirring component to be opened and closed, and torque transmission is formed between the stirring component and the openings during rotation.

6. The stirring device according to claim 5, wherein a movable coupling (14) is mounted to a lower end of the inner telescopic shaft (12); and wherein two connecting plates (15) are mounted in the openings, upper ends of the two connecting plates (15) being connected to the movable coupling (14) respectively, and lower ends of the two connecting plates (15) being connected to the stirring component respectively.

7. The stirring device according to claim 6, wherein the two connecting plates (15) are arranged in an inclined way.

8. The stirring device according to claim 6, wherein when the two stirring plates (16) are folded, the two stirring plates (16) and the two connecting plates (15) are arranged side-by-side along a direction perpendicular to a length direction of the two stirring plates (16), one stirring plate (16) is located at a first side of the two connecting plates (15), the other stirring plate (16) is located at a second side of the two connecting plates (15) opposite to the first side.

9. The stirring device according to claim 1, wherein height of the sleeve shaft (13) is smaller than that of the inner telescopic shaft (12).

10. The stirring device according to claim 1, wherein the rotary rod (11) is in a shape of transverse "L."

11. The stirring device according to claim 1, wherein when the two stirring plates (16) are open, an end portion of the inner telescopic shaft (12) away from the rotary rod (11) is spaced apart from the two stirring plates (16).

12. A tank comprising an exit (22) constructed on a tank body (20), wherein a round mouth (21) for entry and exit of a stirring device is also constructed on the tank body (20);

wherein the stirring device comprises a sleeve shaft (13), an inner telescopic shaft (12), a stirring component, and a rotary rod (11); and wherein the rotary rod (11) is mounted on an upper end of the sleeve shaft (13) for driving the sleeve shaft (13) to rotate; the stirring component is mounted on a lower end of the sleeve shaft (13) and rotates with the sleeve shaft (13); and the inner telescopic shaft (12) is mounted inside of the sleeve shaft (13) and connected to the stirring component for controlling opening and closing of the stirring component;

wherein a sum of width of the two stirring plates (16) and a diameter of the inner telescopic shaft (12) is smaller than a diameter of the sleeve shaft (13), the two stirring plates (16) and the inner telescopic shaft (12) are received in the sleeve shaft (13) when folded to fit to the inner telescopic shaft (12) such that the inner telescopic shaft (12) has a capability to be pulled out directly together with the stirring plates (16) from tank when the sleeve shaft (13) is not pulled out.

13. The tank according to claim 12, wherein the stirring component comprises two stirring plates (16) which have a same structure and are symmetrically arranged;

wherein one end of the stirring plate (16) is in a semicircle shape and another end thereof is in a vertical shape; and wherein a groove (161) is provided on a side of an upper portion of the stirring plate (16), and is connected to the semicircle shape.

14. The tank according to claim 13, wherein the two stirring plates (16) show a horizontal straight line when they are pushed open.

15. The tank according to claim 12, wherein the sleeve shaft (13) is hollow and cylindrical.

16. The tank according to claim 12, wherein openings are provided on two sides of a lower portion of the sleeve shaft (13) for the stirring component to be opened and closed, and torque transmission is formed between the stirring component and the openings during rotation.

17. The tank according to claim 16, wherein a movable coupling (14) is mounted on a lower end of the inner telescopic shaft (12); and wherein two connecting plates (15) are mounted in the openings, upper ends of the two connecting plates (15) being connected to the movable coupling (14) respectively, and lower ends of the two connecting plates (15) being connected to the stirring component respectively.

18. The tank according to claim 17, wherein the two connecting plates (15) are arranged in an inclined way.

19. The stirring device according to claim 12, wherein when the two stirring plates (16) are folded, the two stirring plates (16) and the two connecting plates (15) are arranged side-by-side along a direction perpendicular to a length direction of the two stirring plates (16), one stirring plate (16) is located at a first side of the two connecting plates (15), the other stirring plate (16) is located at a second side of the two connecting plates (15) opposite to the first side.

20. The stirring device according to claim 12, wherein when the two stirring plates (16) are open, an end portion of the inner telescopic shaft (12) away from the rotary rod (11) is spaced apart from the two stirring plates (16).

* * * * *